US007503627B2

(12) United States Patent
Kawasaki

(10) Patent No.: US 7,503,627 B2
(45) Date of Patent: Mar. 17, 2009

(54) SEAT

(75) Inventor: Seiji Kawasaki, Hiroshima (JP)

(73) Assignee: Delta Tooling Co., Ltd., Hiroshima (JP)

( * ) Notice: Subject to any disclaimer, the term of this patent is extended or adjusted under 35 U.S.C. 154(b) by 328 days.

(21) Appl. No.: 11/204,968

(22) Filed: Aug. 17, 2005

(65) Prior Publication Data

US 2006/0055216 A1 Mar. 16, 2006

(30) Foreign Application Priority Data

Aug. 26, 2004 (JP) ..... 2004-247307

(51) Int. Cl.
*A47C 7/02* (2006.01)
*A47C 5/02* (2006.01)

(52) U.S. Cl. ..... 297/452.56; 297/452.55; 297/452.18; 297/452.23

(58) Field of Classification Search ..... 297/452.56, 297/452.18, 452.55, 452.23, 452.24
See application file for complete search history.

(56) References Cited

U.S. PATENT DOCUMENTS 4,521,057 A * 6/1985 Varterasian et al. .... 297/452.57
5,013,089 A 5/1991 Abu-Isa et al.
5,951,110 A * 9/1999 Conner et al. ..... 297/452.31
6,082,824 A * 7/2000 Chow ..... 297/452.56
6,604,792 B1 * 8/2003 Picard ..... 297/452.56
6,755,477 B2 * 6/2004 Chow ..... 297/452.56
6,890,030 B2 * 5/2005 Wilkerson et al. ..... 297/284.11
7,077,478 B2 * 7/2006 Nakamura ..... 297/452.18
7,090,300 B2 * 8/2006 Fujita ..... 297/452.49

FOREIGN PATENT DOCUMENTS

JP A 2002-177099 6/2002
JP A 2002-219985 8/2002
JP A 2003-182427 7/2003

* cited by examiner

*Primary Examiner*—David Dunn
*Assistant Examiner*—Erika Garrett
(74) *Attorney, Agent, or Firm*—Oliff & Berridge, PLC

(57) ABSTRACT

The present invention discloses a seat which is applicable to a vehicle seat, and the seat comprises a seat material whose rear end side is connected to a rear end side of a frame for a sitting portion by way of an elastic member, a plate-like member suppressing deformation of the seat material at a time of sitting, and a fabric-like member suppressing downward sinking of a front portion of the seat material by a tension acting in accordance with sitting.

24 Claims, 12 Drawing Sheets

110
112
114
116
118
120

SEAT

CROSS-REFERENCE TO RELATED APPLICATION

This application claims priority under 35 USC 119 from Japanese Patent Application No. 2004-247307, the disclosure of which is incorporated by reference herein.

BACKGROUND OF THE INVENTION

1. Field of the Invention

The present invention relates to a seat, and more particularly, to a seat such as a vehicle seat which is installed in a vehicle such as an automobile.

2. Description of the Related Art

There is conventionally known, as a vehicle seat, a vehicle seat having a cushion material formed from polyurethane foam (hereinafter called urethane). As the cushion structure of such a vehicle seat, a structure is widely used in which a cushion material made of urethane is placed on a plate or a spring material, such as a contour mat (trade name) or the like provided at a sitting portion frame or a back portion frame, and these are wrapped in a fabric material.

Therefore, it is known that the shape (the design shape) and the elastic characteristic of the cushion material, and the compressive characteristic of polyurethane foam have a great effect on the dispersability of the body pressure of the seated person and vibration absorbability. Further, by structuring the cushion material by layering urethanes which have various characteristics, a cushion material can be obtained which has a spring characteristic (elastic characteristic) which is close to the spring characteristic of the muscles of the buttocks or the like of the seated person. However, with such a structure, there are the problems that there is the sensation that the restoring force is insufficient and that the weight is heavy.

Thus, a seat has been conceived in which, as the cushion material taking the place of urethane, a cushion structure is structured by stretching, over a frame for a sitting portion, a pair of ground knit fabrics and a two-dimensional knit fabric or a three-dimensional solid knit fabric formed by connecting threads which are disposed between the ground fabrics (see, for example, Japanese Patent No. 5013089 and Japanese Patent Application Laid-Open (JP-A) Nos. 2002-177099, 2002-219985 and 2003-182427). The cushion material formed from this three-dimensional solid knit fabric or two-dimensional fabric is an elastic structure which is difficult to weaken, and is thinner than urethane, and exhibits an elastic characteristic in place of urethane.

However, in a conventional vehicle seat in which such a three-dimensional solid knit fabric or two-dimensional fabric as described above is stretched over the frame for the sitting portion, so-called hip slippage (forward sliding), in which the buttocks of the seated person are moved to the central portion of the seat surface, easily occurs resulting in unstable seating posture.

SUMMARY OF THE INVENTION

In view of the aforementioned facts, the present invention provides a seat in which hip slippage of the seated person can be prevented without damaging cushion performance.

A seat which is a first aspect of the present invention comprises a frame for a sitting portion having a pair of left and right side frames, a seat material whose front end side is fixed to a front end side of the frame for the sitting portion and whose rear end side is connected to a rear end side of the frame for the sitting portion by way of an elastic member, a plate-like member which is made to contact with a region of the seat material, including a portion that supports the left and right thighs of the seated person, forward of the buttocks of a seated person at a time of sitting to prevent a deformation of the contact portion of the seat material, and a fabric-like member which is disposed forward of a position in the seat material that corresponds to the buttocks of the seated person and prevents downward sinking of the front portion of the seat material by a tension acting in accordance with sitting.

A seat which is a second aspect of the present invention comprises a frame for a sitting portion having a pair of left and right side frames, a seat material whose front end side is fixed to a front end side of the frame for the sitting portion and whose rear end side is connected to a rear end side of the frame for the sitting portion by way of an elastic member, and a plate-like member which is attached to a further front side of the seat material that is further forward than a position that corresponds to the buttocks of a seated person and which has portions which are positioned at left-right direction external sides of the thighs of the seated person and connected to the left and right side frames by way of a fabric-like member.

Further features of the present invention, as well as the advantages derived therefrom, will become clear from the following descriptions made with reference to the accompanying drawings in which:

DETAILED DESCRIPTION OF THE INVENTION

With reference to the drawings, a preferred embodiment of the present invention will be explained in more detail.

A vehicle seat 10, which serves as a seat according to an embodiment of the present invention, will be described on the basis of FIGS. 1 through 12. Note that arrow FR, arrow RE, arrow UP, arrow LO, arrow RI and arrow LE shown as appropriate in the respective drawings denote the front direction (traveling direction), the rear direction, the upward direction, the downward direction, the rightward direction, and the leftward direction, respectively, with the traveling direction of the vehicle in which the vehicle seat 10 is installed being the point of reference. When merely upward, downward, front, rear, right, or left are designated hereinafter, they correspond to the directions of the aforementioned respective arrows.

Figure 2:
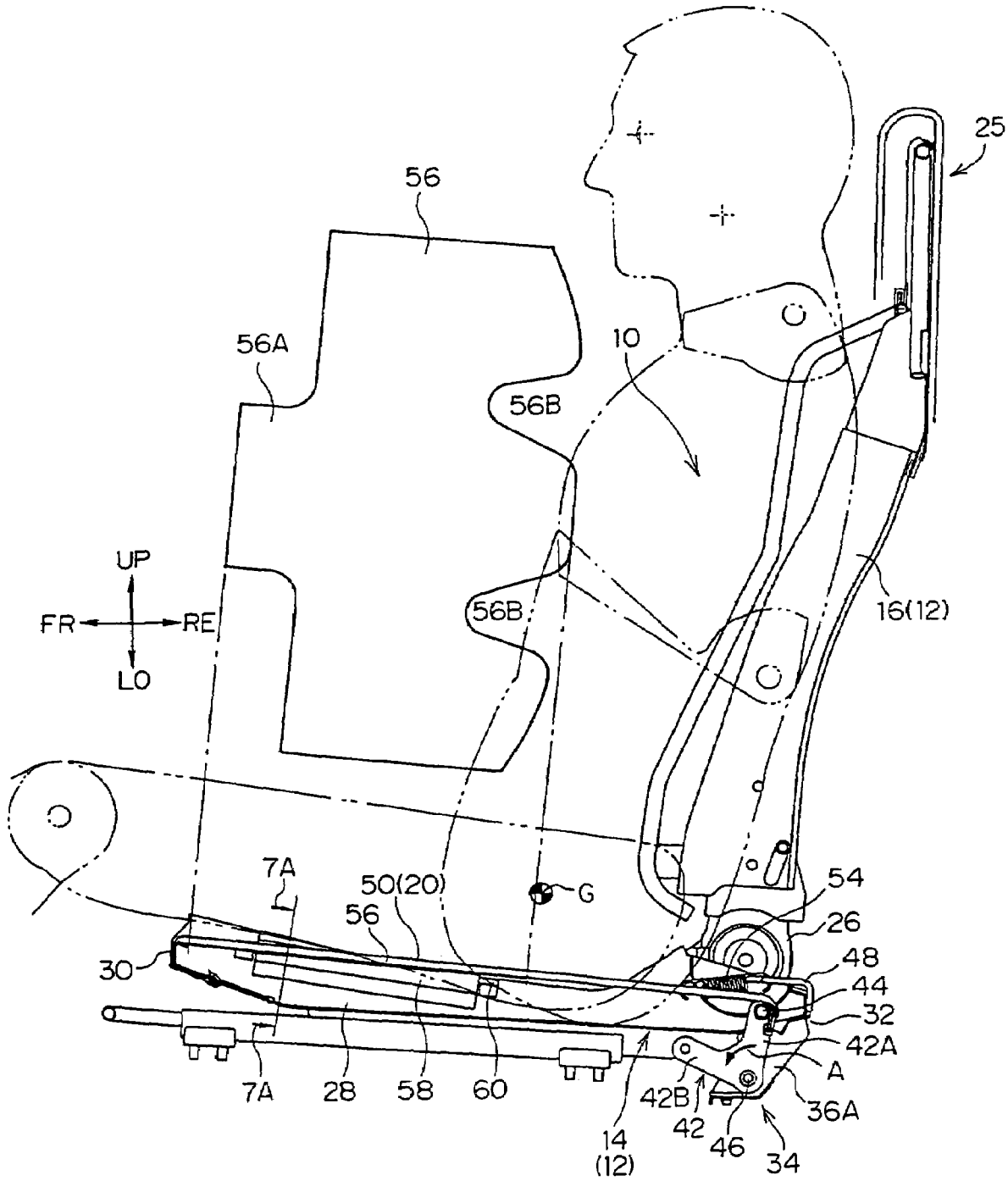
FIG. 2 is a side view of the vehicle seat according to an embodiment of the present invention.
Figure 3:
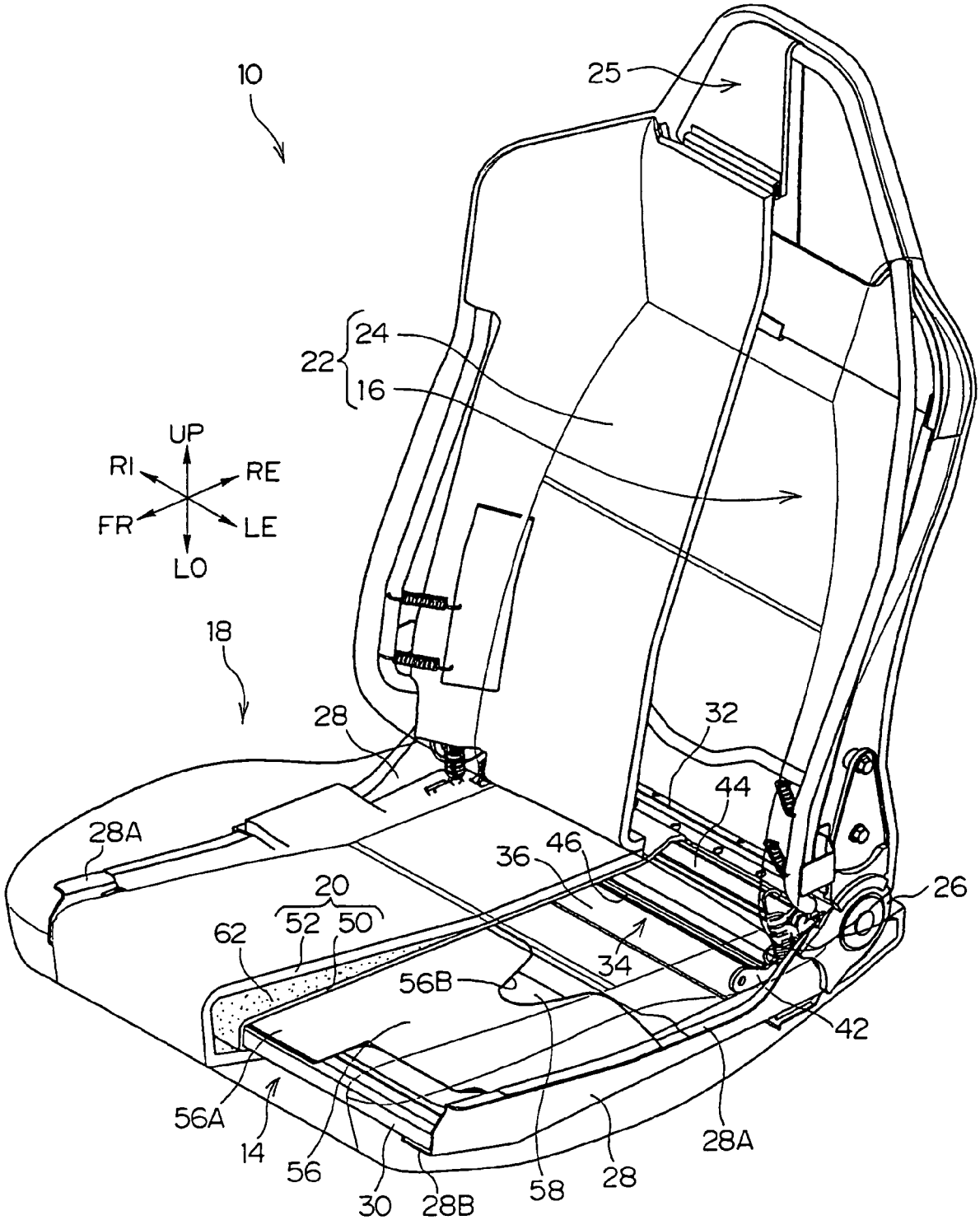
FIG. 3 is a perspective view, a portion of which is cut-away, showing a schematic overall structure of the vehicle seat according to an embodiment of the present invention.

In FIG. 3, a schematic overall structure of the vehicle seat 10 is shown in a perspective view, a portion of which is cut away. A side view of the vehicle seat 10 is shown in FIG. 2. As shown in these drawings, the vehicle seat 10 has a seat frame 12. The seat frame 12 comprises a sitting portion frame 14 serving as a seat cushion frame, and a back portion frame 16 serving as a seat back frame.

Further, a cushion material 20 is disposed at the sitting portion frame 14, so that a seat cushion 18 serving as the sitting portion is formed, and a cushion material 24 for a back portion is disposed at the back portion frame 16, so that a seat back 22 is formed. Moreover, a headrest 25 is provided above the seat back 22.

Although a detailed description thereof is omitted, the seat back 22 is structured such that the back portion cushion material 24 which is a tension structural body (for example, a two-dimensional fabric such as a fabric spring material or a three-dimensional solid knit fabric 110 which will be described later) is stretched over the back portion frame 16 which is an elastic structural body, via elastic members (such as extension coil springs or arms connected to a torsion bar). The lower end of the back portion frame 16 is connected via a reclining mechanism 26 to the rear end portion of the sitting portion frame 14 so as to be able to rotate around a supporting shaft, whereby the seat back 22 can be rotated around the supporting shaft, and held at any given rotation position, with respect to the seat cushion 18.

Hereinafter, the specific structure of the seat cushion 18 will be explained, and then, a specific example of a three-dimensional solid knit fabric 110, which structures the cushion material 20 will be explained.

Figure 1:
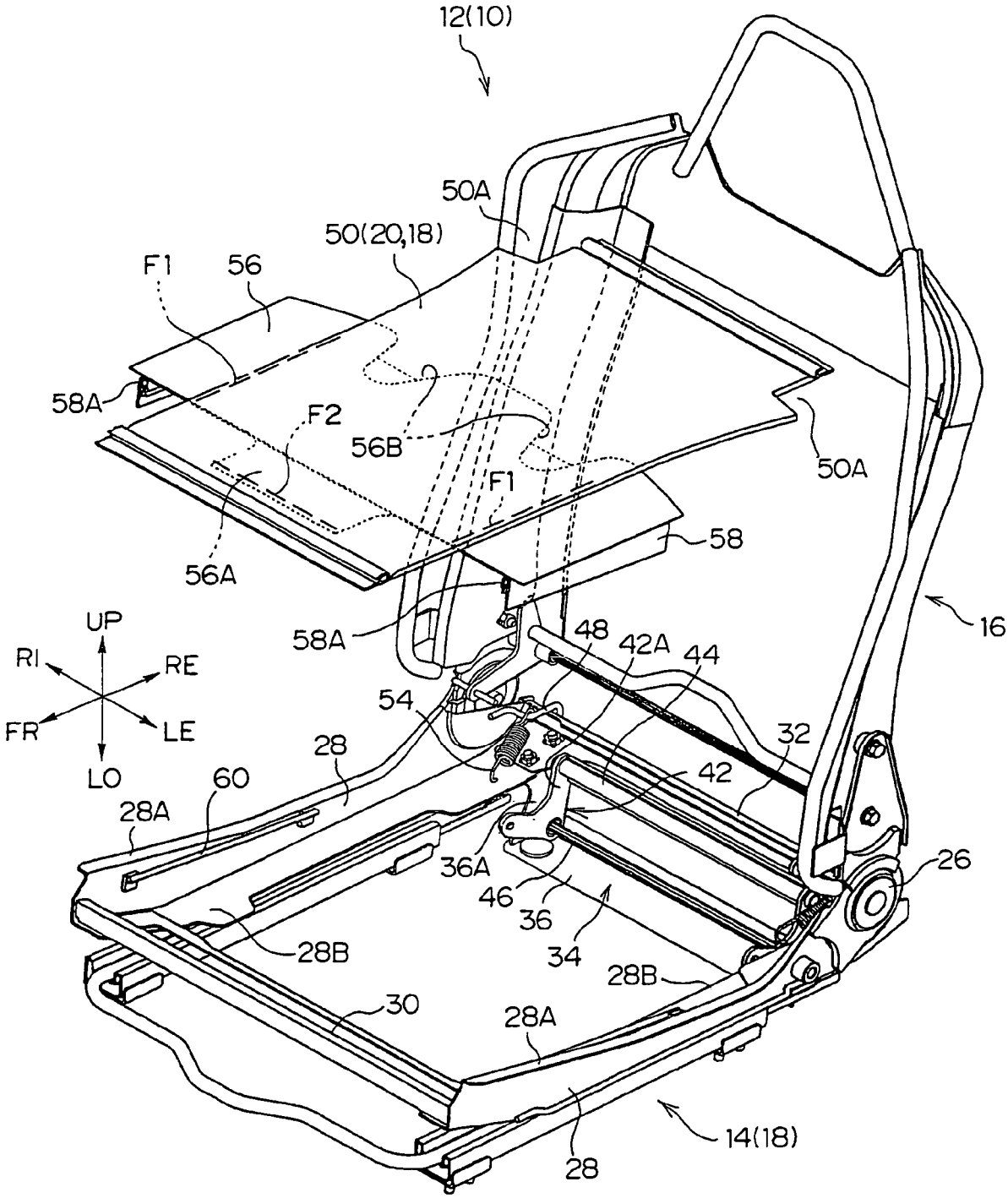
FIG. 1 is a perspective view in which a lower layer seat is separated from a seat frame for structuring a vehicle seat according to an embodiment of the present invention.

As shown in FIGS. 1 and 2, the sitting portion frame 14 structuring the seat cushion 18 has a pair of left and right side frames 28 whose front-rear direction is a lengthwise direction. Further, the sitting portion frame 14 has a front frame 30 and a rear frame 32 for connecting the pair of left and right side frames 28 near the front end and the rear end, respectively. By this, the sitting portion frame 14 is formed in a substantially square shape.

The front portion of each side frame 28 is formed so as to bend upwardly with respect to the substantially horizontal lower edge of the intermediate portion of each side frame 28. The upper edge portion of the intermediate portion of each side frame 28 is continuously inclined so the upward-downward direction width thereof is gradually reduced rearward. In this way, the front-rear direction upper edge of each intermediate portion at a position corresponding to the ischial tuberosities of a seated person is lower than the upper end of the front frame 30. The upper edge of the rear portion of each side frame 28 rises in an inverted V-shape as seen from a side view for attaching the reclining mechanism 26 thereto.

Further, the respective side frames 28 comprise upper flange portions 28A and lower flange portions 28B each of which has a predetermined width. The upper flange portions 28A which are positioned at the upper ends of the respective side frames 28 are extended in the outer directions of the seat, and are disposed substantially along the entire front-rear direction lengths, except for the rear portions, of the side frames 28. On the other hand, the lower flange portions 28B which are positioned at the lower ends of the respective side frames 28 are extended in the inner directions of the seat, and disposed substantially along the entire front-rear direction lengths of the side frames 28.

Figure 5A:
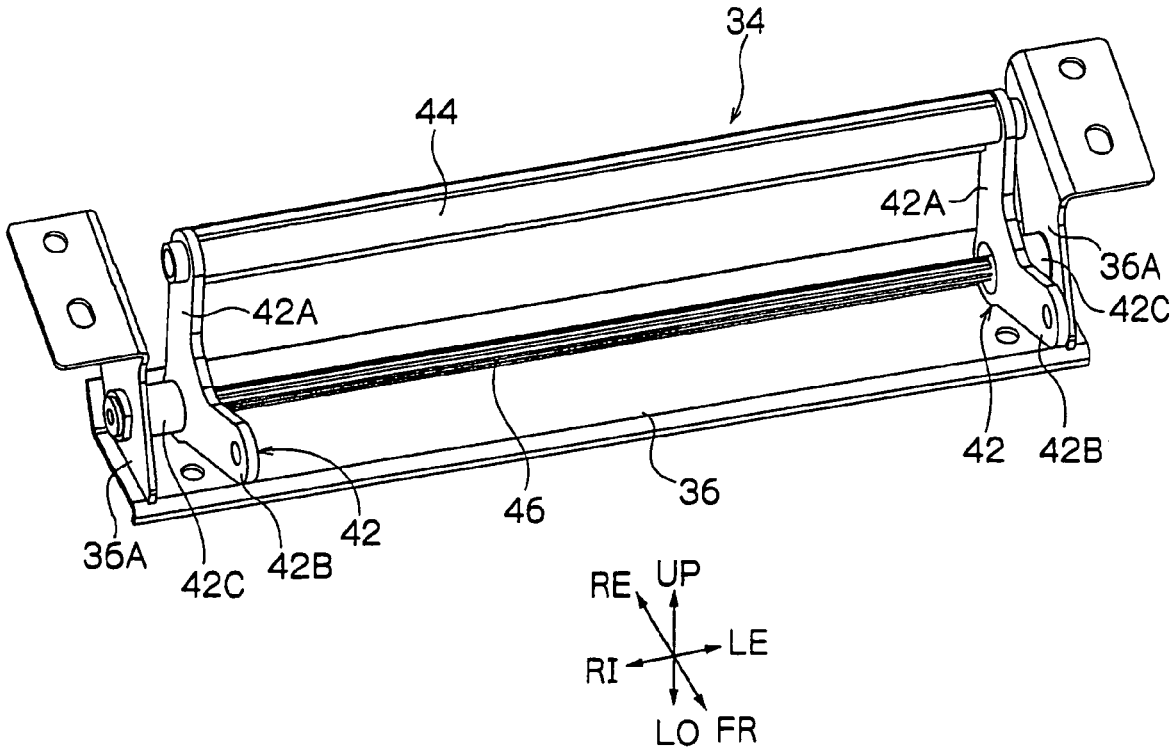
FIG. 5A is a perspective view of a movable frame for structuring the vehicle seat according to an embodiment of the present invention.
Figure 5B:
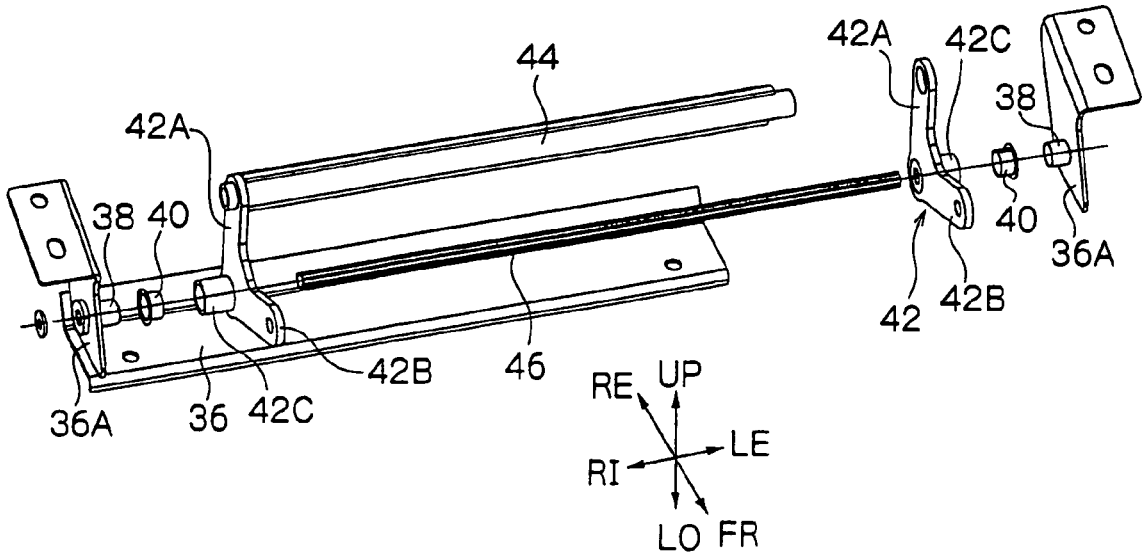
FIG. 5B is an exploded perspective view of the movable frame for structuring the vehicle seat according to an embodiment of the present invention.

A movable frame 34 is disposed at the rear portion of the sitting portion frame 14. The movable frame 34 has a supporting bracket 36 which is securely disposed at the rear end portion of the sitting portion frame 14 to protrude downward therefrom. As shown in FIGS. 5A and 5B, the supporting bracket 36 has a pair of left and right supporting plates 36A which are disposed parallel to the respective side frames 28 and in an inner direction of the seat. Supporting shafts 38 are disposed so as to protrude from the lower end vicinities of the respective supporting plates 36A in an inner direction of the seat and to be coaxial with each other. The respective supporting shafts 38 axially support the lower end portions of arm members 42 via bushes 40 such that the arm members 42 are freely rotatable around the supporting shafts 38 via the bushes 40.

Each of the pair of left and right arm members 42 is provided with a first arm 42A and a second arm 42B to form a substantially V shape as seen from a side view, and is rotatably supported, as described above, around the supporting bracket 36 by each supporting shaft 38 being inserted into each boss portion 42C, which are disposed at the lower end and formed at the corner portion of each arm member 42, via each bush 40C. Further, a connecting pipe 44, which spans the interval between the tip ends of the respective first arms 42A (the upper end portions of the respective first arms 42A), connects the pair of arm members 42. The connecting pipe 44 is disposed in parallel to the axis of each supporting shaft 38 along the left-right direction, and can rotate around the supporting shafts 38. On the other hand, a torsion bar 46 serving as an "elastic member" in the present invention is disposed at the axial center of rotation of the pair of left and right arm members 42.

One end portion of the torsion bar 46 is joined to the supporting plate 36A in a non-rotatable state while passing through the boss portion 42C of the right-hand side arm member 42 and the axial center of the right supporting shaft 38, so that rotation of the torsion bar 46 relative to the sitting portion frame 14 is prevented. On the other hand, the other end portion of the torsion bar 46 is joined to the boss portion 42C of the left-hand side arm member 42 in a non-rotatable state, so that the torsion bar 46 is connected to the left-hand side arm member 42 so as to be able to rotate coaxially and integrally therewith. Accordingly, in accordance with the rotation (swinging) of the arm member 42, the torsion bar 46 serving as an elastic member generates a twisting load in proportion to a twisting angle, and is structured to elastically twist.

At the movable frame 34, the connecting pipe 44 is for anchoring the rear end side of the cushion material 20 (a lower layer seat 50 which will be described later). In an unloaded state, each first arm 42A of the pair of the arm members 42 is inclined slightly rearward from its upright state (the upper end of the first arm 42A is positioned further rearward than the lower end). In this state, each second arm 42B is positioned further frontward than each first arm 42A.

Further, spring hanging members 48 are disposed at the respective left-right direction end portions at the rear end portion of the sitting portion frame 14. The respective spring hanging members 48 are securely connected to the rear frame 32 and the rear portions of the corresponding side frames 28. Each spring hanging member 48 is for anchoring the rear end portion of an extension coil spring 54 which will be described later, and a region for anchoring is higher than the upper edge of the intermediate portion of the side frame 28.

The cushion material 20 is stretched over the above-described sitting portion frame 14. As shown in FIG. 3, the cushion material 20 is structured by a lower layer seat 50 serving as a seat material in the present invention and an upper layer seat 52 which is disposed on the top of the lower layer seat 50, to form a double layer structure. In the present embodiment, each of the lower layer seat 50 and the upper layer seat 52 is structured by a three-dimensional solid knit fabric 110 of a mesh (net) structure, so that elongation in a seat surface direction accompanying internal damping due to tension, and restoration due to canceling of that tension, are possible. In addition, due to the lower layer seat 50 and the upper layer seat 52 being structured by the three-dimensional solid knit fabric 110, squashing in a seat thickness direction accompanying internal damping due to load in a direction crossing the seat surface direction, and restoration due to canceling of that load, are possible.

Further, in the present embodiment, the lower layer seat 50 has a hard spring characteristic of being difficult to elongate in front-rear and left-right directions, while the upper layer seat has a soft spring characteristic of being easy to elongate in a left-right direction and a hard spring characteristic of being difficult to elongate in a front-rear direction. Further, in the present embodiment, the lower seat layer 50 is thinner than the upper seat layer 52, but the thickness of the lower seat layer 50 can be equivalent to or larger than that of the upper seat layer 52.

As shown in FIG. 2, the lower layer seat 50 is anchored to the front frame 30 by the front end portion being wound around the front frame 30, and the rear end portion of the lower layer seat 50 is anchored to the connecting pipe 44 of the movable frame 34. The width of the lower layer seat 50 is smaller than the distance between the left side frame 28 and the right side frame 28, and gaps are formed between the left and right edge portions of the lower layer seat 50 and the corresponding side frames 28. Further, cut-away portions 50A are formed at both the left and right ends of the rear end of the lower layer seat 50, so that the width of the rear end of the lower layer seat 50 is smaller than that of the other portions. The width between the cut-away portions 50A corresponds to the length of the connecting pipe 44. The rear end of the lower layer seat 50, which corresponds to the distance between the cut-away portions 50A, is anchored to the connecting pipe 44 substantially along the entire width thereof. The length of the connecting pipe 44 is larger than the distance between the ischial tuberosities of a seated person.

In view of the above, the rear end of the lower layer seat 50 is movable in accordance with rotation of the arm members 42 around the supporting shafts 38. In a state in which the upper layer seat 52 is not installed, the initial tensile force of the lower layer seat 50 (which is mainly in equilibrium with the twisting load of the torsion bar 46) is equivalent to or smaller than 200 N, and the front-rear direction elongation of the lower layer seat 50 is equivalent to or smaller than 5%. In this state, the respective spring characteristics of the lower layer seat 50 and the torsion bar 46, the inclination angles of the arm members 42 in a free state before the lower layer seat 50 is anchored to the torsion bar 46, the length of each arm member 42 (the rotation radius of the connecting pipe 44), and the like are determined in such a manner that the torsion bar 46 is twisted, and as described above, the respective first arms 42A are slightly inclined rearward.

Further, when the lower layer seat 50 is flexed downward due to with sitting, the connecting pipe 44 of the movable frame 34 is moved downward while rotating in a direction of arrow A as shown in FIG. 2 to move forward. Namely, as the rear end of the lower layer seat 50 which is anchored to the connecting pipe 44 approaches the front end of the lower layer seat 50 which is fixed to the front frame 30, in accordance with sitting, the lower layer seat 50 is supported by tension based on the twisting load of the torsion bar 46. Accordingly, at this time, the tension acting on the lower layer seat 50 becomes smaller than in a case in which the movable frame 34 is not provided (for example, a case in which the rear end of the lower layer seat 50 is directly anchored to the rear frame 32).

Moreover, the respective front end portions of the extension coil springs 54 are anchored to the cutaway portions 50A of the lower layer seat 50 in the vicinity of the front edges and at the left-right direction end portions thereof. The respective rear end portions of the extension coil springs 54 are anchored to the corresponding spring hanging members 48 of the sitting portion frame 14. In this state, the respective front ends of the extension coil springs 54 are positioned at further inner sides and at further upper sides than the respective rear ends. In a state in which the upper layer seat 52 is not provided, each extension coil spring 54 is in a free state or in an elongated state within a predetermined length (the amount of elongation is equivalent to or smaller than 10 mm in the present embodiment).

In accordance with sitting, these extension coil springs 54 are structured to elongate due to a downward flexure of the lower layer seat 50, and apply tension to both the left and right end portions of the lower layer seat 50. Namely, at a time of sitting, the extension coil springs 54 operate the movable frame 34 (the torsion bar 46) to adjust the front-rear direction tension between the cutaway portions 50A (at the left-right direction central portion) of the lower layer seat 50 so as to decrease the tension and, in contrast, to adjust the front-rear direction tension at both the left-right direction end portions of the lower layer seat 50 so as to increase the tension. Then, in accordance with sitting, the respective extension coil springs 54 are structured to apply the front-rear direction tension to the left-right direction external side portions of the pelvis of the seated person thus increasing tension applied to the lower layer seat 50 portions which support the thighs of the seated person (at the body side).

In view of the above, the lower layer seat 50 is structured such that a tension field in a three-dimensional tension direction (which will be described later) is produced by the movable frame 34 as a two-dimensional spring element forming a surface state tension field (the torsion bar 46), and the left and right extension coil springs 54 as one-dimensional spring elements each forming a tension line.

Further, as shown in FIG. 1 in which the lower layer seat 50 is removed, a thin resin plate 56 serving as a "plate-like member" in the present invention is attached to the bottom surface of the lower layer seat 50. The resin plate 56 is formed, for example, of a resin material such as polypropylene (PP), has sufficiently high rigidity with respect to the lower layer seat 50, and is a planar plate which is able to bend in the thickness direction (having a thickness of about 1 mm). When the resin plate 56 is made wider than the lower layer seat 50 in the left-fight direction, it is disposed further frontward than a position that corresponds to the buttocks of the seated person in the lower layer seat 50, to greatly increase the rigidity (the supporting pressure) of the front portion of the lower layer seat 50 thereby preventing forward sliding of the buttocks of the seated person (stiffening the front portion of the lower layer seat 50). When the left and right portions of the wide resin plate 56 are secured to the lower layer seat 50 by sewing or the like as described below, the support pressure is further increased. Such a structure is appropriate for a so-called "sports seat". On the other hand, as shown by imaginary lines in FIG. 4, when the width of the resin plate 56 is set equivalent to or smaller than that of the lower layer seat 50 (in particular, set to a narrower width), and when the resin plate 56 is fixed to the lower layer seat 50 only at the front portion of an extension portion 56A (which will be described later) of the resin plate 56, the pressure supporting the pelvis of the seated person is not extremely high and, instead, the resin plate 56 can be flexed in front-rear, left-right and upward-downward directions in accordance with the physique or the sitting manner of the seated person (without correcting the sitting posture of the seated person) to produce a soft supporting pressure. Such a structure is suitable for a so-called "luxury seat".

Figure 4:
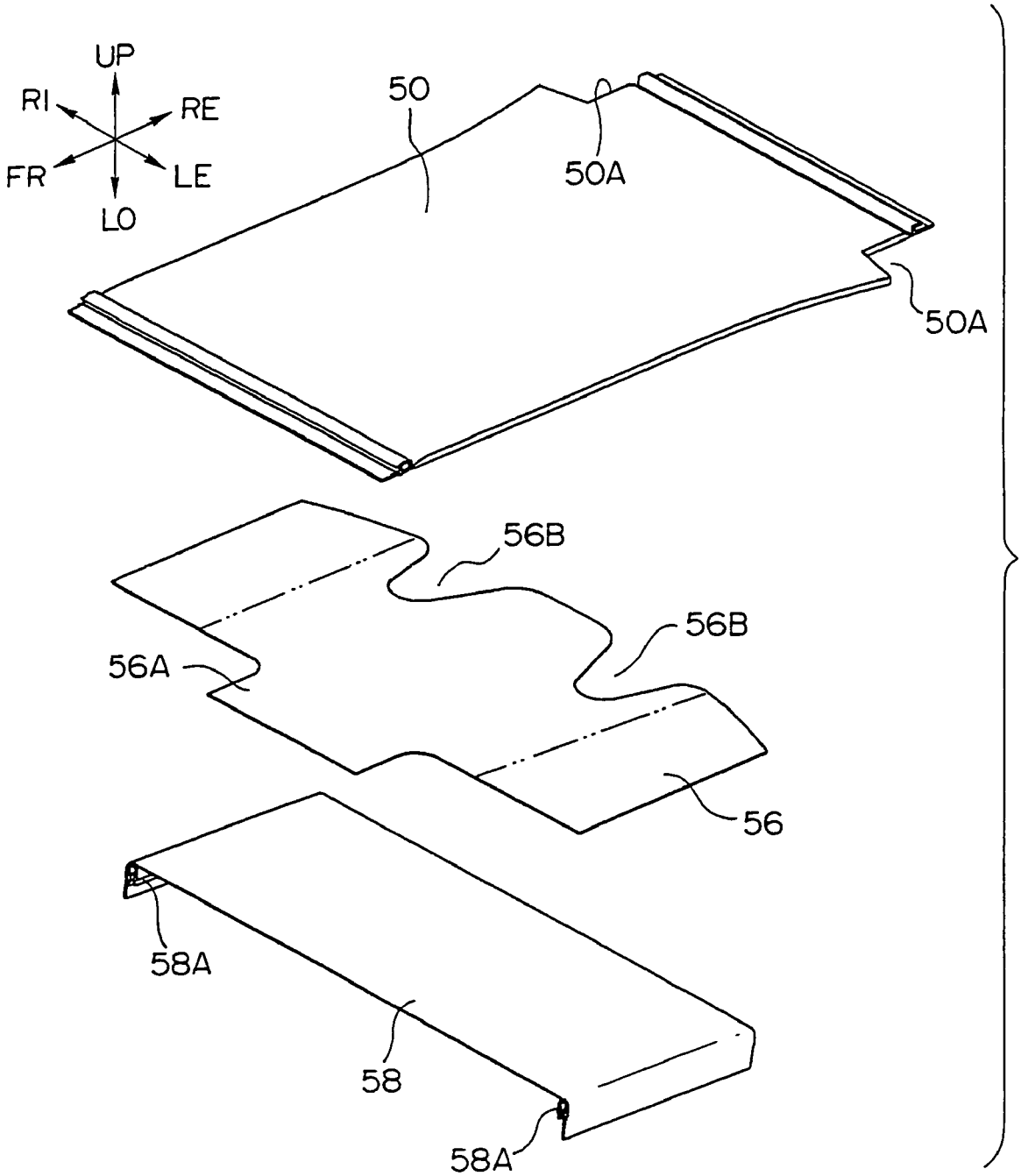
FIG. 4 is an exploded perspective view of the lower layer seat, a resin plate, and a supporting cloth for structuring the vehicle seat according to an embodiment of the present invention.

Specifically, as shown in FIGS. 2 and 4, the resin plate 56 is formed such that the rear edge of the plate material, which as a whole is formed into a rectangular shape whose left-right direction is a lengthwise direction as seen from a plan view, is formed into a substantially arc shape, and a rectangular extension portion 56A is formed so as to extend from the central portion in a left-right direction of the front end of the resin plate 56. The left-right width of the resin plate 56 is equivalent to the distance between the left and right side frames 28, and the rear end of the extension portion 56A (the central portion in a left-right direction of the rear end) is positioned slightly further frontward than the center of gravity position G of the seated person which is shown in FIG. 2, in a state in which the front edge of the extension portion 56A corresponds to the front frame 30. Further, a pair of left and right cutaway portions 56B is formed at the rear portion of the resin plate 56 so as to correspond to the thighs of the seated person.

A structure in which strong supporting pressure is produced by the above-described resin plate 56 will be explained. The resin plate 56 is wider than the lower layer seat 50, and is connected to the sitting portion frame 14 via a supporting cloth 58 serving as a "cloth-like member". The supporting cloth 58 is a two-dimensional tensile force structural member which is more difficult to elongate in the left-right direction than the lower layer seat 50 which is a three-dimensional solid knit fabric. The supporting cloth 58 is formed into a rectangular shape whose left-right direction is a lengthwise direction as seen from a plan view, and has hook portions 58A at both the left and right direction end portions.

The supporting cloth 58 is anchored by the hook portions 58A to anchoring bars 60 which are fixed to the seat internal side surfaces of the respective side frames 28 in order to prevent a front-rear direction displacement of the supporting cloth 58. As shown in FIG. 2, each anchoring bar 60 is inclined with respect to each side frame 28 (the lower layer seat 50) such that the front end of the anchoring bar 60 is higher than the rear end, and the upper position of the front end of each anchoring bar 60 substantially corresponds to that of the lower layer seat 50 in a non-sitting state.

The front-rear direction length of the supporting cloth 58 (the anchoring bar 60) substantially corresponds to that of the respective left-right direction end portions of the resin plate 56. The front-rear direction length of the supporting cloth 58 at the left-light direction central portion is slightly shorter than that of the resin plate 56. The supporting cloth 58 is fixed to the resin plate 56 which is fixed to the lower layer seat 50 in a state in which the front end of the supporting cloth 58 corresponds to the front end of the resin plate 56 (without the extension portion 56A).

In other words, both the resin plate 56 and the supporting cloth 58 are fixed to the lower layer seat 50. In the present embodiment, the lower layer seat 50, the resin plate 56, and the supporting cloth 58 are laminated to one another in this order from the top, and in a state without the application of tension, they are sewn together in a front-rear direction and fixed to one another at fixing points F1 near both the left and right direction ends of the lower layer seat 50. Accordingly, the supporting cloth 58 is extended between the left and right side frames 28, and is interposed between the resin plate 56 (at further outer side portions in the left-fight direction than the thighs (the cut-away portions 56B)) and each side frame 28, to connect the resin plate 56 and each side frame 28. Further, at the resin plate 56, the front end of the extension portion 56A which is fixed to the front end of the lower layer seat 50 (after stretching) by sewing is a fixing point F2.

In a state in which the lower layer seat 50 is stretched at the sitting portion frame 14, the front end of the extension portion 56A of the resin plate 56, which front end is sewn to the lower layer seat 50, is anchored to the front frame 30 and held (between the front frame 30 and the lower layer seat 50). Further, in a state in which the respective hook portions 58A of the supporting cloth 58 are anchored to the corresponding anchoring bars 60, the left-right direction tension is hardly at all applied to the lower layer seat 50, the resin plate 56, and the supporting cloth 58.

Figure 6:
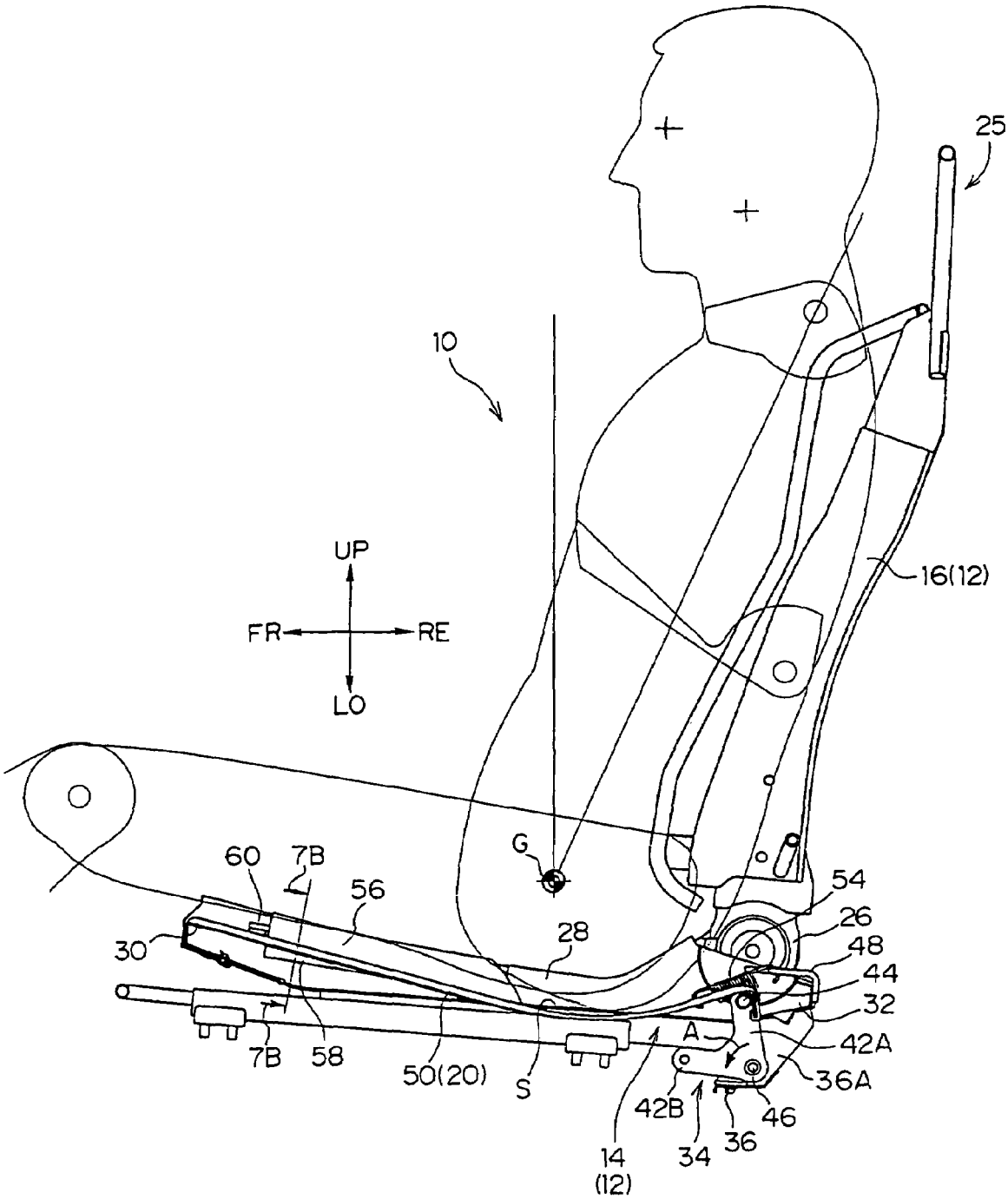
FIG. 6 is a side view of a state in which a seated person sits down on the vehicle seat according to an embodiment of the present invention.
Figure 7A:
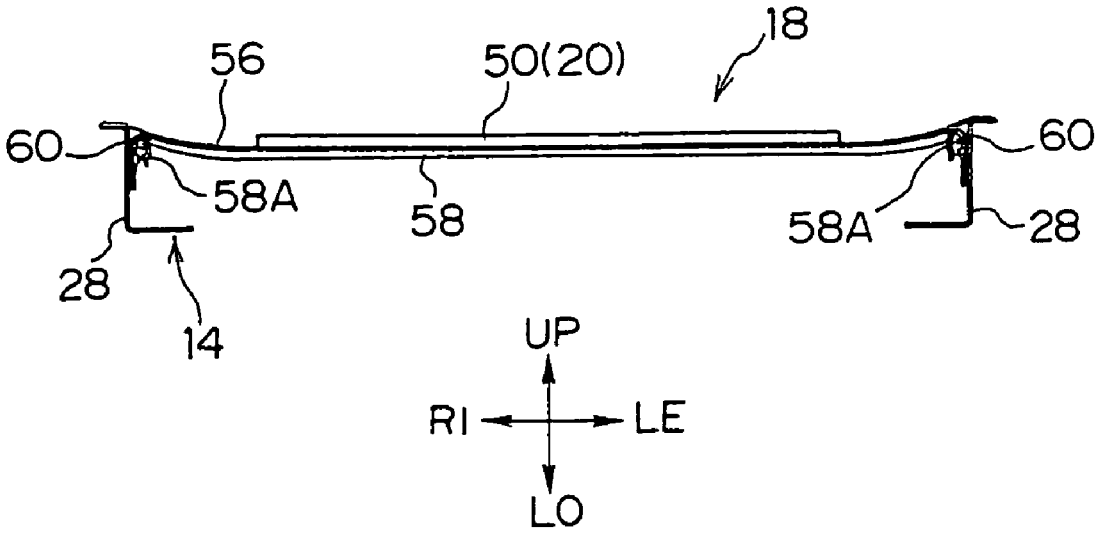
FIG. 7A is a cross-sectional view taken along line 7A-7A of FIG. 2.
Figure 7B:
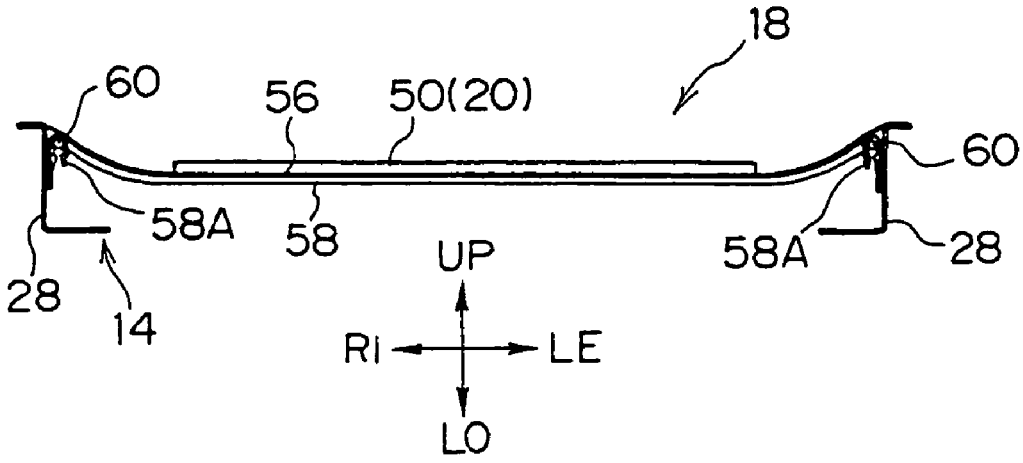
FIG. 7B is a cross-sectional view taken along line 7B-7B of FIG. 6.

When, as shown in FIG. 6, the lower layer seat 50 attempts to sink while flexing downward in accordance with sitting, the left-right direction tension is produced at the resin plate 56 and the supporting cloth 58, so that the structure prevents downward sinking of the region where the lower layer seat 50 is in contact with the resin plate 56. Specifically, the tension which is applied to the supporting cloth 58 due to downward flexure of the lower layer seat 50, is applied between the left and right portions of the resin plate 56 (the most difficult member to elongate) sewn to the lower layer seat 50. Accordingly, as compared to a structure in which the resin plate 56 and the supporting cloth 58 are not provided, downward sinking of the lower layer seat 50 can be suppressed. Further, as described above, since the anchoring bars 60 are inclined, the resin plate 56 and the supporting cloth 58 do not form discontinuous deformation portions (such as step portions) at the lower layer seat 50 in accordance with sitting, and the lower layer seat 50 is formed into a natural configuration which prevents the seated person from feeling a sensation of physical discomfort. Accordingly, downward sinking of the lower layer seat 50 can be suppressed.

Moreover, the rigidity of the resin plate 56 is increased due to the aforementioned tension, and at a time of sitting, the resin plate 56 is structured so as to attempt to keep the front portion of the lower layer seat 50 flat. In other words, by sitting, the front portion of the lower layer seat 50 is changed from a state shown in FIG. 7A to that shown in FIG. 7B. However, due to the rigidity of the resin plate 56, there is no downward flexure in accordance with sitting at the central portion in a left-right direction or at portions that correspond to the thighs of the seated person and a flat state in the left-right direction of the lower layer seat 50 can be maintained in a sitting state as well. Further, while not shown in the drawings, in order to produce the aforementioned soft supporting pressure, the resin plate 56 having a narrow width as shown by imaginary lines in FIG. 4, is fixed to the lower layer seat 50 merely at the fixing point F2. With this structure, the supporting pressure at a time of sitting (the shape of the lower layer seat 50 and that of the resin plate 56 as seen from front views) can be produced smoothly.

On the other hand, as shown in FIG. 3, the upper layer seat 52 is disposed on the top of the lower layer seat 50, and stretched at the sitting portion frame 14. Specifically, hook portions are disposed at both the left and right ends of the upper layer seat 52, and anchored to the upper flange portions 28A of the corresponding side frames 28. A hook portion is disposed at the front end of the upper layer seat 52 along the left-right direction and turned around the front frame 30. Accordingly, the upper layer seat 52 is anchored to the lower portion of the front frame 30. Although the rear end of the upper layer seat 52 is connected fixedly to the lower end of the cushion material 24 for the back portion, the rear end is in a substantially free end state. Elongations in both the left-right direction and in the front-rear direction of the upper layer seat 52 in a non-sitting (non-load) state are 5% or less.

The rear portion of the upper layer seat 52 is laminated on top of the lower layer seat 50, and the front portion and the portion which turns around the front frame 30 of the upper layer seat 52 are spaced away from the lower layer seat 50 by a spacer member 62 which is disposed between the upper seat layer 52 and the lower layer seat 50. The spacer member 62 is formed, for example, of polyurethane foam or the like. Therefore, the front-end portion of the seat cushion 18 is formed so as to rise higher than the other portions thereof. Further, the rear portion of the upper layer seat 52 gently pushes the rear portion of the lower layer seat 50 to move downward and flex slightly (see FIG. 3). Accordingly, in the stretched state of the upper layer seat 52, the torsion bar 46 is slightly rotated in the direction of arrow A (to the extent that the rearward inclination is maintained), so that the tension of the lower layer seat 50 is decreased.

In this state (non-sitting state), the left and right extension coil springs 54 are slightly elongated. The restoring force of the lower layer seat 50, which is produced by slightly twisting the torsion bar 46 and by extending each of the extension coil springs 54, is held due to the friction occurring between the upper layer seat 52 and the lower layer seat 50. Further, in this state, the front-rear direction portions of the lower layer seat 50 including portions that correspond to the ischial tuberosities of the seated person are positioned higher than the upper edge of each side frame 28, i.e., than the upper flange portion 28A at the intermediate portion of each side frame 28. Consequently, a downward-moving stroke of the rear end portion of the lower layer seat 50 in accordance with the rotation of the connection pipe 44 in the direction of arrow A at a time of sitting can be secured.

With the seat cushion 18 having the above-described structure, basically, the weight of the seated person is mainly supported by the lower layer seat 50, and a part of the weight of the seated person is supported by the upper layer seat 52. Further, at the lower layer seat 50, the weight of the seated person is mainly supported by the tension of the torsion bar 46, and the weight of the seated person is shared and supported by the tensions of the extension coil springs 54. Moreover, the seat cushion 18 combines the upper layer seat 52 with the lower layer seat 50 at which a three-dimensional direction tension field is formed in accordance with sitting as described above to thereby match the entire compliance to the compliance of the human body (the seated person), and to the muscle impedance (torque transmitting characteristic) that varies in accordance with the degree of tension, posture or vibration. Accordingly, a pressure or a force of constraint, and stresses such as pain or numbness which are applied to the seated person due to the transmission of vibration can be mitigated, so that the accumulation of fatigue after seating for a long period of time can be reduced.

Specifically, at the seat cushion 18, the rear end of the lower layer seat 50 is anchored to the connecting pipe 44, and is elastically supported on the sitting portion frame 14 via the torsion bar 46, so that the overall tension of the seat cushion 18 is reduced, the tension of both the left-right direction ends of the seat cushion 18 are set high by the respective extension coil springs 54, and the tension of the front portion thereof is set high by the resin plate 56 and the supporting cloth 58.

In other words, a low rigidity surface is structured between high tension regions due to the extension coil springs 54 at the rear portion of the seat cushion 18. A characteristic is realized whereby at the low rigidity surface a spring constant of a portion for supporting a convex portion of the human body is smaller than that of other portions (hereinafter, a "spring zero characteristic"). At the seat cushion 18, due to the spring zero characteristic, interruption of breathing by the seated person (body movements accompanying a breath) is suppressed, blocking performance with respect to vibration (amplitude) is improved, and changes of body pressure during the application of vibration are reduced.

The low rigidity surface for realizing the spring zero characteristic is disposed so as to include the region beneath the ischial tuberosities of the seated person. Further, in the present embodiment, the position beneath the ischial tuberosities of the seated person is set at a distance of substantially 150 mm from the front-rear direction rear end of the seat cushion 18 (from the front surface at the lower portion of the seat back 22 at a time of sitting). Moreover, a distance between the left and right ischial tuberosities is from 100 mm to 130 mm.

On the other hand, the high-tension regions due to the extension coil springs 54 are set at the external sides of the pelvis of the seated person, to implement a body side supporting structure for supporting regions from the buttocks to the thighs (at the femoral sides) at both sides. Further, the resin plate 56 and the supporting cloth 58 form an elastic dam S (see FIG. 6) in accordance with sitting, within a desired range at the front of a region that corresponds to a position beneath the ischial tuberosities. The elastic dam S is understood to be a portion at which the lower layer seat 50, which is flexed downward, rises toward the front frame 30.

Further, the resin plate 56 is disposed such that the elastic dam S is formed at a distance of 100 mm or less from a position beneath the ischial tuberosities toward the front. In the present embodiment, the elastic dam S is formed at a distance of 30 mm to 50 mm from the position beneath the ischial tuberosities toward the front. Moreover, at the seat cushion 18, an anchor effect is created by the spring zero characteristics in which the region beneath the ischial tuberosities of the seated person is embedded in the cushion material 20.

In view of the above, in the seat cushion 18, forward sliding of the seated person is suppressed by the dam S, which is an elastic member, and the anchor effect, and due to the seated person being supported from the buttocks to the femoral regions at the regions which are high rigidity surfaces, front-rear and left-right movement of the seated person is suppressed. For these reasons, the structure of the seat cushion 18 is such that forward sliding and the hammock sensation, which is a phenomenon whereby the seated posture is unstable, are eliminated and a flat sensation with respect to rolling or left-light direction inputs can be obtained. In the vehicle seat 10 according to the embodiment of the present invention, the hip sliding prevention function of the elastic dam S is particularly excellent. However, this will be described later together with the operation of the present embodiment.

As described above, due to a solid-state support in a three-dimensional direction, tension fields having high tension portions and low tension portions are formed on the lower layer seat 50, whereby total impedance matching and total compliance matching are achieved between the cushion material 20 and the human body. For this reason, the offset force (the tangent direction of the surface) and the pressure (the normal line direction) which are applied to the skin and muscles of the seated person are mitigated due to the seat cushion 18 maintaining the posture of the seated person, and numbness or pain due to sitting for a long time period can be reduced.

Next, an example of the three-dimensional solid knit fabric 110, which is used as the lower layer seat 50 and the upper layer seat 52 structuring the cushion material 20, (and the cushion material 24 for the back portion) will be described.

Figure 9:
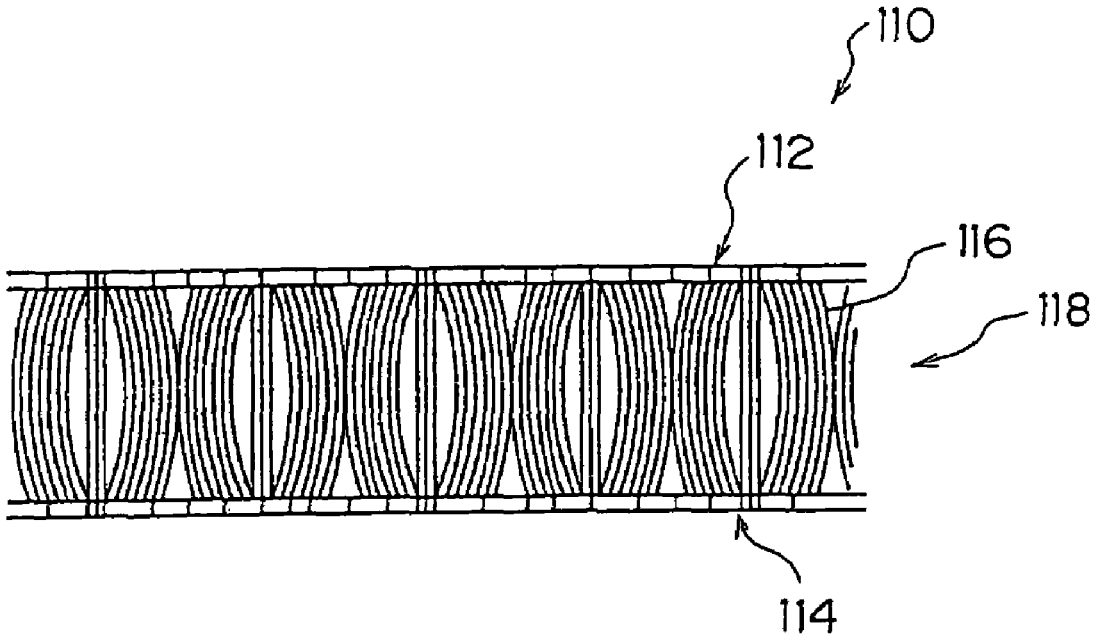
FIG. 9 is a schematic side view showing a three-dimensional solid knit fabric used as a cushion material.

As shown in FIG. 9, the three-dimensional solid knit fabric 110 is structured by a pair of ground knit fabrics 112, 114 which are disposed so as to be separated from one another, and a pile portion 118 which is formed by a large number of connecting threads 116 which go back and forth between the pair of ground knit fabrics 112, 114 and join the two.

Figure 10:
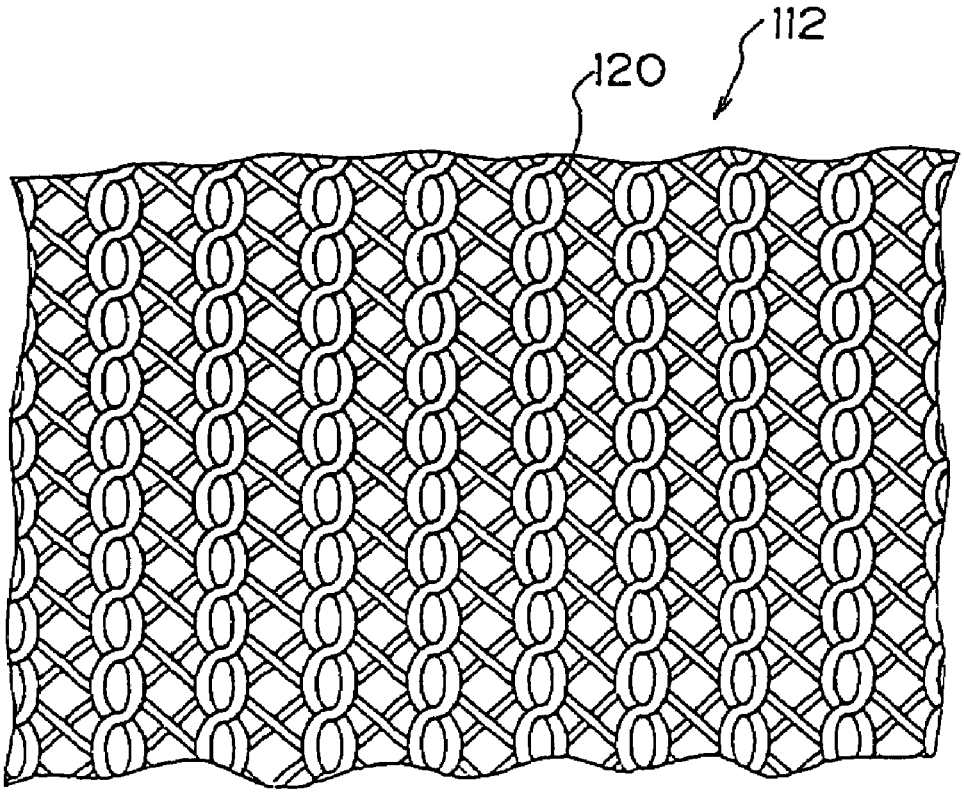
FIG. 10 is a schematic diagram showing an example of one ground knit material used in the three-dimensional solid knit fabric.
Figure 11:
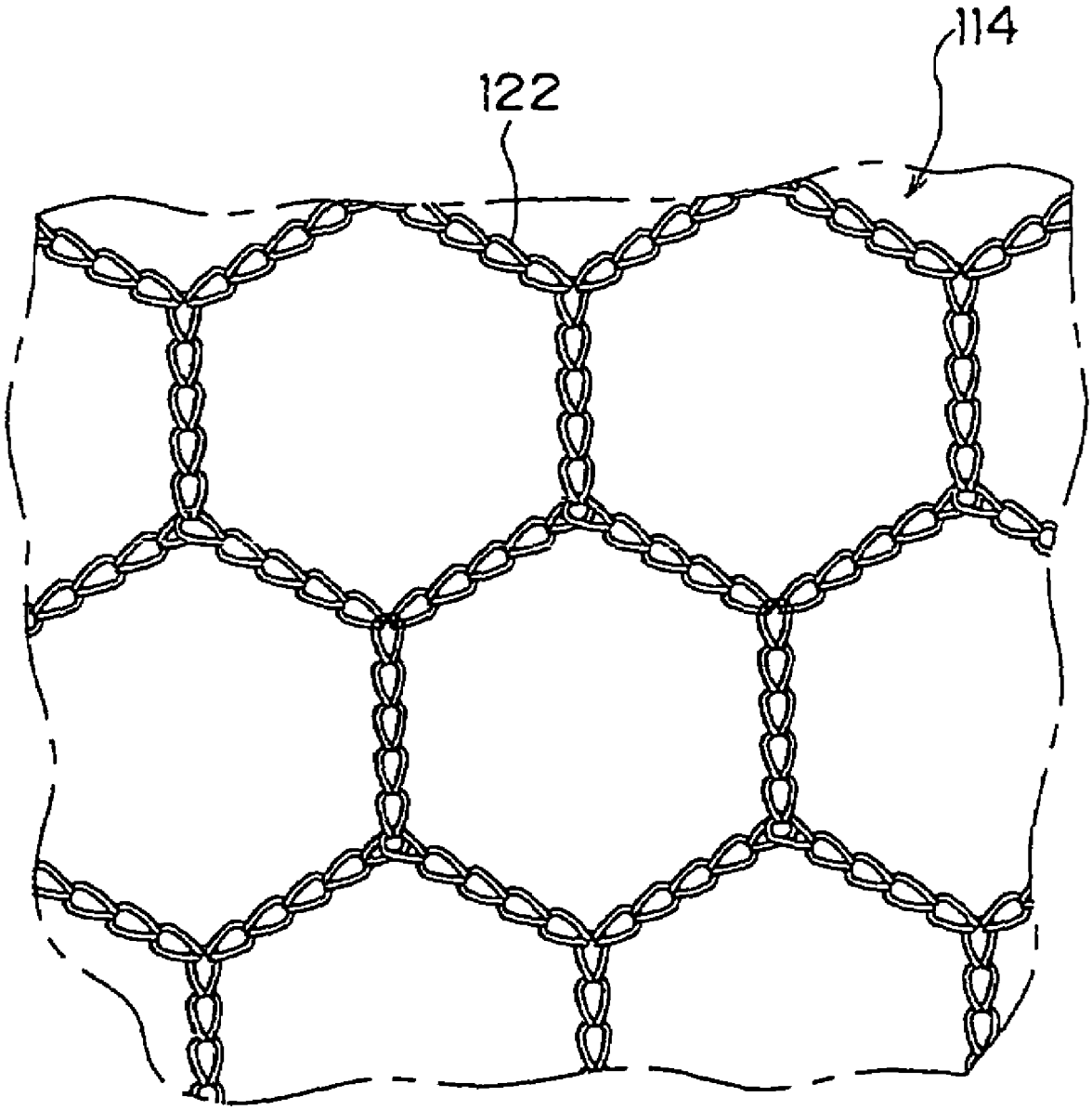
FIG. 11 is a schematic diagram showing an example of another ground knit material used in the three-dimensional solid knit fabric.

For the one ground knit fabric 112, for example, as shown in FIG. 10, what is used is a structure which forms a mesh by a flat, knit fabric weave which is continuous in both the wale direction and the course direction, from threads 120 in which short fibers are twisted. Further, as shown in FIG. 11, for example, the other ground knit fabric 114 forms a honeycomb-shaped mesh from threads 122 in which short fibers are twisted. Moreover, the other ground knit fabric 114 is a mesh which is larger than the one ground knit fabric 112. Note that the ground knit fabrics 112, 114 are not limited to a fine weave or a honeycomb shape, and may be structures using mesh-like knit fabric weaves other than these.

As shown in FIG. 9, the connecting threads 116 form the pile portion 118 by being knit-in between the ground knit fabrics 112, 114 so as to hold the one ground knit fabric 112 and the other ground knit fabric 114 at a predetermined interval. In this way, a predetermined rigidity is imparted to the three-dimensional solid knit fabric 110, which is a mesh knit.

The three-dimensional solid knit fabric 110 can provide the required stiffness in accordance with the thickness and the like of the ground threads (the threads 120, 122) which form the ground knit fabrics 112, 114, but it is preferable that the ground threads 120, 122 be selected from those in a range in which the knitting work is not difficult. Further, monofilament threads can be used as the ground threads 120, 122, but in consideration of the touch and the softness of the feel of the surface and the like, multifilament threads or spun threads may be used.

As the connecting threads 116, it is preferable to use monofilament threads, and those whose thickness is in a range of 167 decitex to 1110 decitex are preferable. With multifilament threads it is not possible to obtain a cushionability that has a good restoring force. Further, when the thickness is less than 167 decitex, the stiffness of the three-dimensional solid knit fabric 110 is low, and when the thickness is greater than 1110 decitex, it becomes too hard, and the proper amount of cushionability cannot be obtained.

Namely, by using monofilament threads of 167 decitex to 1110 decitex as the connecting threads 116, the load of the vehicle occupant seated on the seat can be supported by the deformation of the meshes forming the ground knit fabrics 112, 114, the deformation due to the collapsing or buckling of the connecting threads 116 forming the pile portion 118, and the restoring force of the adjacent connecting threads which impart a spring characteristic to the deformed connecting threads 116, and it is possible to form a soft structure which has a soft spring characteristic and in which concentration of stress does not occur.

Note that recesses and protrusions may be formed at the three-dimensional solid knit fabric 110. Namely, the ground knit fabrics 112, 114 may be fabrics which are knit such that recesses and projections arise at the surfaces thereof. When recesses and projections are formed, spring elements which are substantially arch-shaped in cross-section can be formed at the ground knit fabrics 112, 114, and therefore, an even softer spring characteristic can be imparted, and a structure having elastic compliance which is substantially equivalent to or greater than the elastic compliance of muscles can be easily formed. Note that the elastic compliance is calculated by (flexing amount)/(average pressure value of surface of contact).

The raw materials of the ground threads 120, 122 and the connecting threads 116 are not particularly limited, and may be, for example, synthetic fibers or regenerated fibers such as polypropylene, polyester, polyamide, polyacrylonitrile, rayon, or the like, or natural fibers such as wool, silk, cotton, or the like. These raw materials may be used singly, or may be used together in any given combination. They are preferably a thermoplastic polyester type fiber exemplified by polyethylene terephthalate (PET), polybutylene terephthalate (PBT) and the like, or a polyolefin type fiber exemplified by nylon 6, nylon 66 and the like, or a fiber combining two or more types of these fibers.

Further, the thread shapes of the ground threads 120, 122 and the connecting threads 116 also are not limited to the above description, and threads of round cross-sections or threads of irregularly-shaped cross-sections or the like may be used.

The pile weave of the pile portion 118, which is the way of arranging the connecting threads 116 forming the pile portion 118, can be classified into the types shown in FIG. 12A through FIG. 12E, which express the connecting threads 116 which connect the respective ground knit fabrics 112, 114 as seen from a side surface.

Figures 12A, 12B, 12C, 12D, 12E:
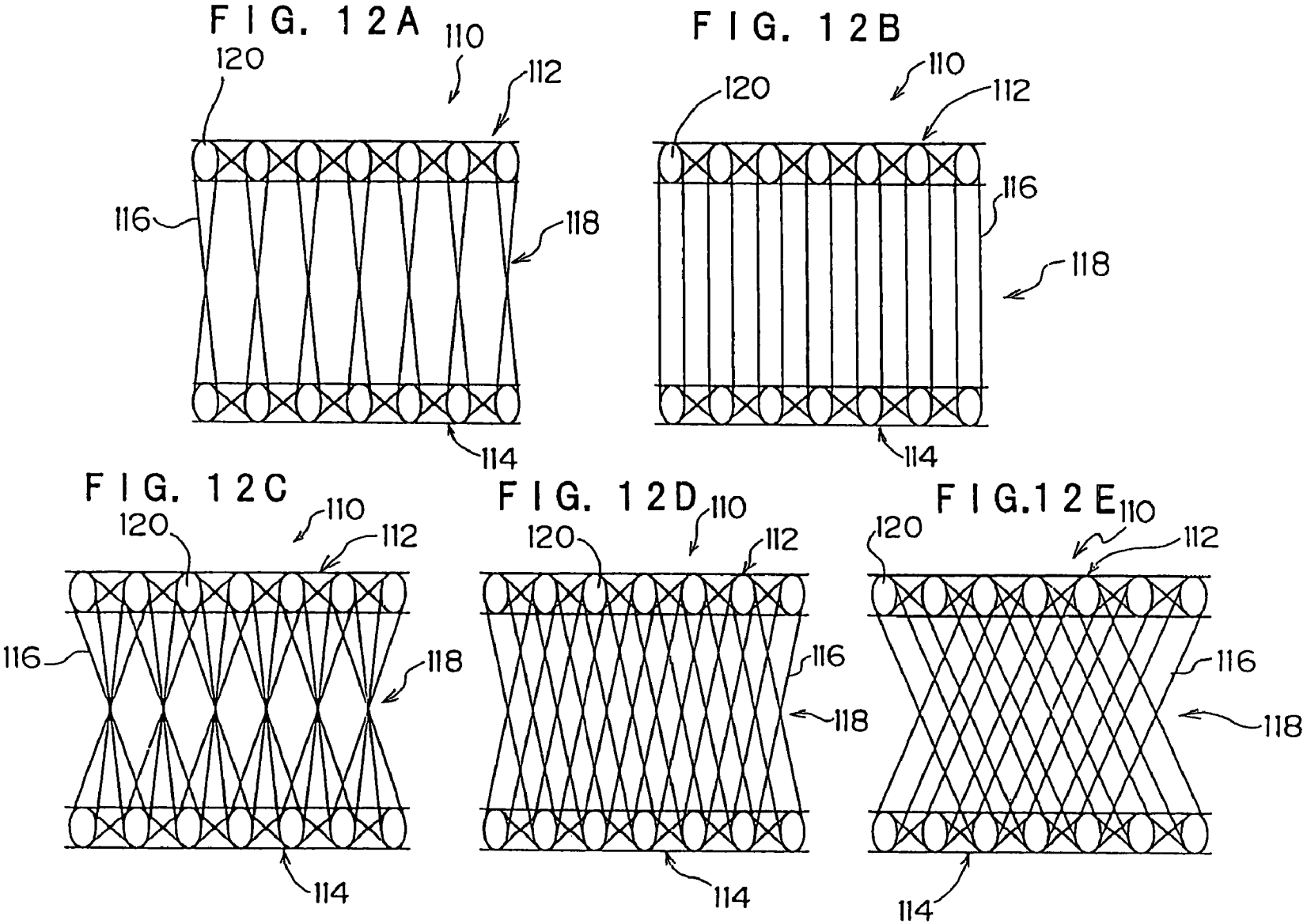
FIGS. 12A through 12E are respectively schematic sectional views of main portions of the three-dimensional solid knit fabric, showing applied examples of a pile portion.

FIG. 12A and FIG. 12B are straight types in which the connecting threads 116 are knit-in substantially perpendicularly between the ground knit fabrics 112, 114. Of these, FIG. 12A is a structure which is knit straight in figures-of-eight, and FIG. 12B is a structure which is knit simply straight.

Further, FIG. 12C, FIG. 12D, and FIG. 12E show cross types in which the connecting threads 116 are knit so as to intersect midway along, between the ground knit fabrics 112, 114. Of these, FIG. 12C is a structure in which the connecting threads 116 are crossed in figures-of-eight, FIG. 12D is a structure in which the connecting threads 116 are merely crossed, and FIG. 12E is a structure in which the connecting threads 116 are gathered together two-by-two and crossed (double-crossed).

Note that, as shown in FIG. 12C through FIG. 12E, when the connecting threads 116 intersect one another and are disposed obliquely, as compared with forms (see FIG. 12A, FIG. 12B) in which the connecting threads 116 are disposed substantially perpendicularly between the ground knit fabrics 112, 114, there is the advantage that a soft spring characteristic having a large compression rate can be imparted while maintaining sufficient restoring force by the buckling strength of the respective connecting threads 116.

At the lower layer seat 50 and the upper layer seat 52 using the three-dimensional solid knit fabric 110 having such a mesh structure, the spring property is small, the damping ratio is high, deformation following the physique of the vehicle occupant occurs easily, and it is easier to fit.

Note that the above-described structures of the three-dimensional solid knit fabric 110 are examples and, for example, three-dimensional solid knit fabrics having various types of stitch structure such as, for example, stitch structures in which convex portions or concave portions, or ribs or the like are formed in the surface, can be used at the lower layer seat 50 and the upper layer seat 52. Further, three-dimensional solid knit fabrics of different stitch structures may be used in accordance with the application and the function.

Next, operation of the present embodiment will be described.

In the vehicle seat 10 having the above-described structure, when a person sits down, at the seat cushion 18 the weight of the seated person is mainly supported by the lower layer seat 50 (the torsion bar 46 and the extension coil springs 54), and a part of the weight of the seated person is shared and supported by the upper layer seat 52. Specifically, at a time of sitting, the upper layer seat 52 is flexed downward while extending mainly in the left-fight direction, to thereby press the lower layer seat 50 downward. The lower layer seat 50 is moved downward by moving the connecting pipe 44 of the movable frame 34 forward while twisting the torsion bar 46, and is flexed downward (sunk) while suppressing the increase of tension. At this point, the left and right extension coil springs 54 are extended so that a tension line is formed at the external sides of the pelvis of the seated person. The supporting cloth 58 is extended due to the lower layer seat 50 flexing downward. The front portion of the lower layer seat 50, which is prevented from flexing and which is held substantially flat due to the rigidity of the resin plate 56, is prevented from sinking downward due to the tension of the supporting cloth 58.

Figure 13A:
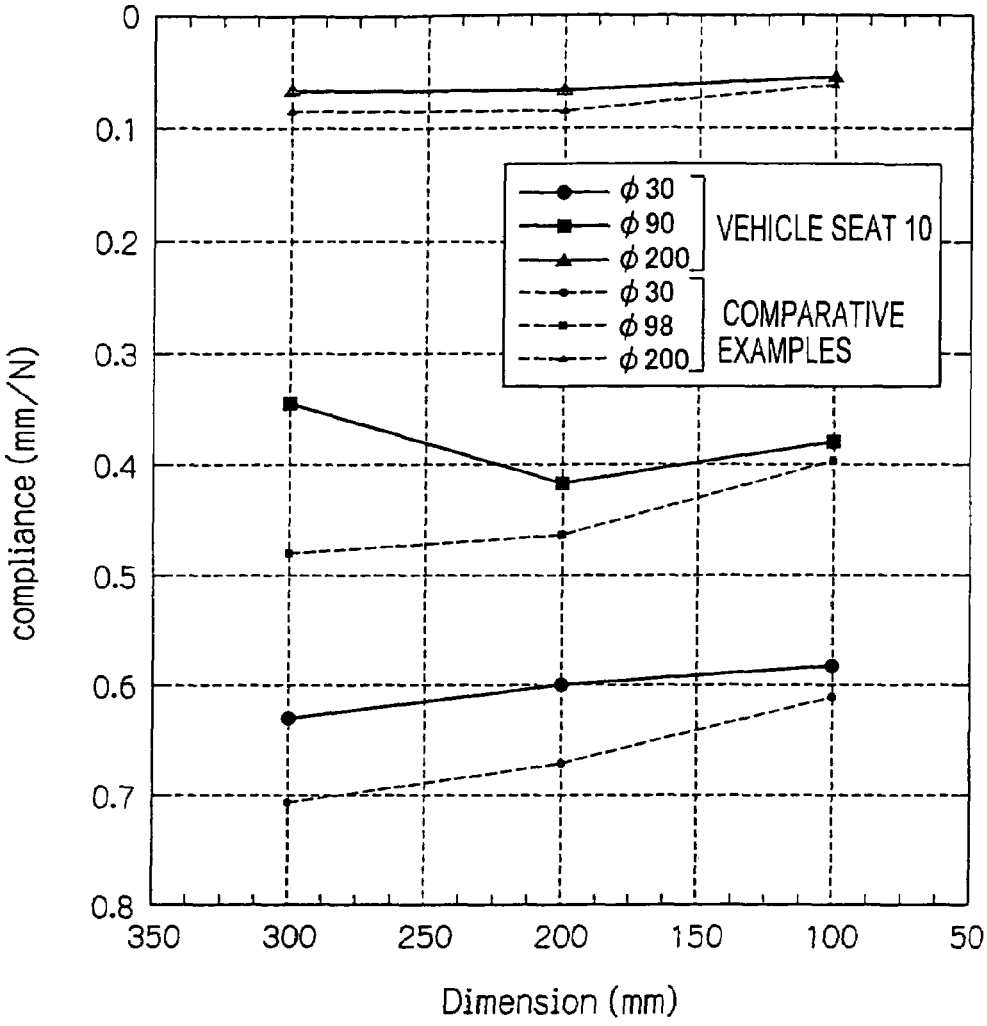
FIG. 13A is a chart showing compliances at respective portions of a seat cushion for structuring the vehicle seat according to an embodiment of the present invention.
Figure 13B:
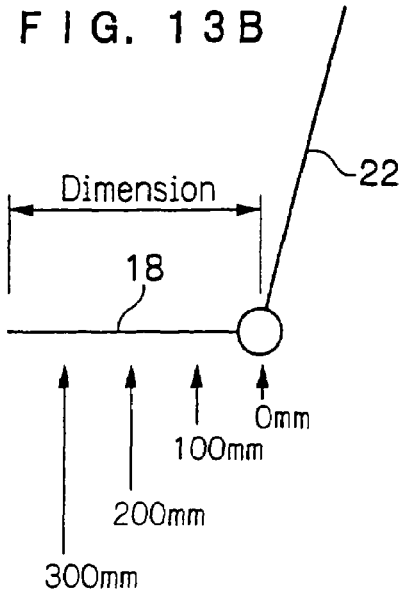
FIG. 13B is a diagram showing the measurement points of the compliances.

In this way, although the entire surface rigidity of the lower layer seat 50 is low, the above-described tension fields, in which surface rigidity becomes higher than at other portions, are formed at both the left and right direction end portions of the lower layer seat 50 to which the tension of the extension coil springs 54 is applied and at a region of the lower layer seat 50 at which the resin plate 56 is installed (with which the resin plate 56 contacts), to support the weight of the seated person. Further, a part of the weight of the seated person is supported by the upper layer seat 52 which is stretched at the sitting portion frame 14, independently of the lower layer seat 50. FIG. 13A illustrates the static compliances of portions shown in FIG. 13B in the front-rear direction of the seat cushion 18 including the lower layer seat 50 and the upper layer seat 52. In this figure, a position of 300 mm from the rear end of the seat cushion 18 corresponds to a position of a substantially central portion in the front-rear direction of the resin plate 56. The respective plots connected by solid lines are compliances when disc plates having diameters shown in this chart are pressed against the seat cushion 18 at a speed of 50 mm/min. Further, in this chart, as comparative examples, compliances for portions, each having a structure in which the resin plate 56 and the supporting cloth 58 are not installed, are shown by broken lines. From this figure, in the seat cushion 18 of the vehicle seat 10 according to the present embodiment, as compared to the comparative examples, it is shown that the occurrence of "sinking" is minor at respective portions of the seat cushion 18, especially at a portion where the seat cushion 18 contacts with the resin plate 56. Moreover, the compliance at a region of the seat cushion 18 that corresponds to the buttocks of the seated person is smaller than that in the comparative examples. However, the degree (about 5%) for the difference is acceptable as long as the difference does not affect the operational effect based on the spring zero characteristic (the anchor effect).

At the seat cushion 18, at a time of sitting, the seated person is supported at the body side while distributing body pressure from the buttocks to the thighs, and the elastic dam S is formed in front of the ischial tuberosities. Further, at the seat back 22, the upper body of the seated person is supported with suitable supporting pressures for the respective portions of the seat back 22. For this reason, at the vehicle seat 10, posture maintenance in which use of the muscles by the seated person is not required due to the body side support and the elastic dam S, and the dispersion of body pressure due to the spring zero characteristic at the low rigidity surfaces, exist at the same time. Moreover, since the increase in tension of the lower layer seat 50 in accordance with sitting is suppressed, a large damping ratio at the seat cushion 18 can be obtained and a sufficient restoring force is imparted by the torsion bar 46. By this, the seat cushion 18 can exhibit excellent absorbance of vibration and impact. In this way, accumulation of fatigue due to sitting for a long period of time can be suppressed. In particular, at the seat cushion 18, the cushion material 20 comprises the lower layer seat 50 and the upper layer seat 52 which are the three-dimensional solid knit fabrics 110, and the rear end of the lower layer seat 50 is elastically connected to the rear end of the sitting portion frame 14 by way of the movable frame 34 (the torsion bar 46). Consequently, there is inhibition of the movement of the coccygeal bone when the seated person breathes (the seat cushion 18 conforms to the micro movement of the coccygeal bone with almost no resisting force thereto being generated).

Since the resin plate 56 for suppressing flexure in the lower layer seat 50 accompanying sitting and the supporting cloth 58 for suppressing sinking in the lower layer seat 52 accompanying sitting are provided, the elastic dam S is formed in accordance with sitting, and forward sliding (hip slippage) of the seated person can be reliably prevented.

Figure 8A:
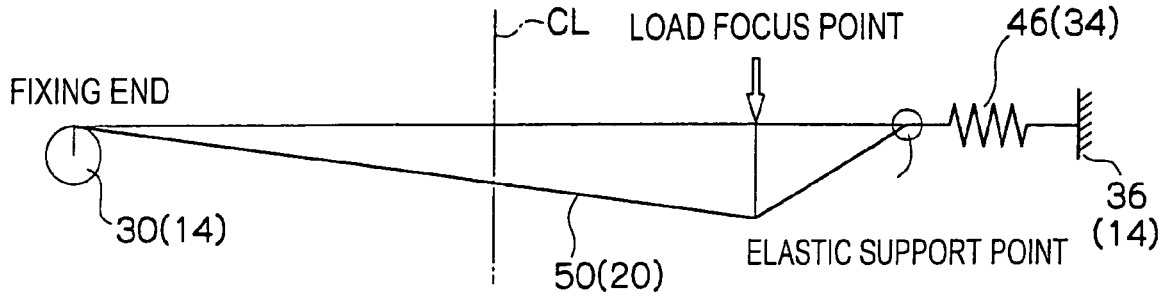
FIG. 8A is a pattern diagram showing a state of the lower layer seat at a time of sitting, and explaining a uniform supporting method.

With reference to FIG. 8, this will be explained. Further, for the sake of convenience, FIG. 8 is a pattern diagram in which a load focus point (beneath the ischial tuberosities of the seated person) and a longitudinal position of the elastic dam S correspond to each other. In FIG. 8A, a state in which a load focus point (gravity position) is placed at a further rear end side than the front-rear direction center line CL of the lower layer seat 50 whose front end is fixed and whose rear end is elastically supported is shown in a pattern diagram.

Figure 8B:
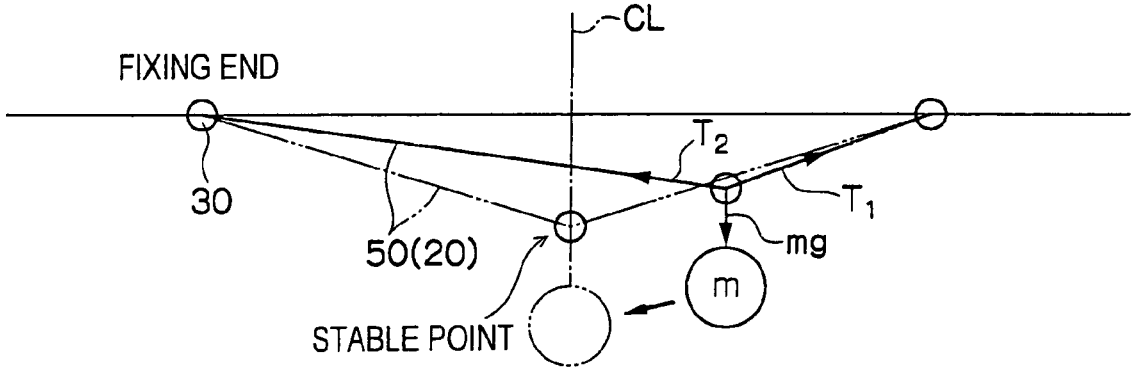
FIG. 8B is a pattern diagram showing a state of the lower layer seat at a time of sitting, and explaining a state of hip slippage.

In a static state, as shown by a solid line in FIG. 8B, since a load focus point mg and tensions T1 and T2 are equilibrium with one another, the position of the load focus point mg is not changed. On the other hand, for example, when vibrations or impacts are inputted, and an elastic supporting point becomes free, the tension T1 cannot be maintained and, as shown by an imaginary line in FIG. 8B, the load focus point attempts to move to a stabilization point (center line). The movement of the load focus point is equivalent to the hip slippage of the seated person.

Figure 8C:
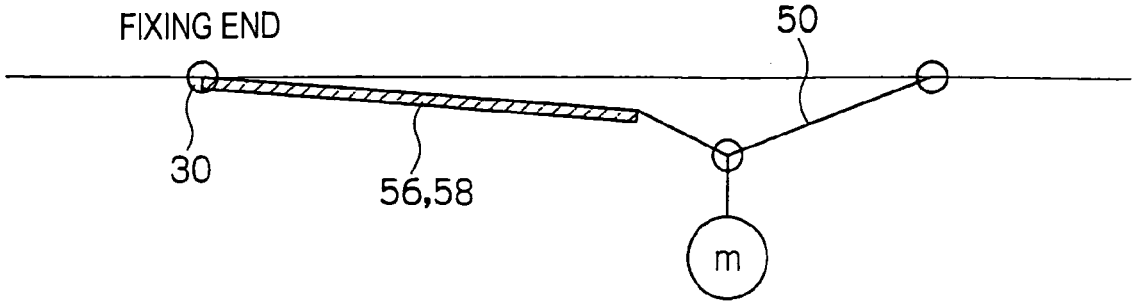
FIG. 8C is a pattern diagram showing a state of the lower layer seat at a time of sitting, and showing that hip slippage is prevented by the resin plate and the supporting cloth for structuring the vehicle seat according to an embodiment of the present invention.

In the vehicle seat 10 according to the present embodiment, the front portion of the lower layer seat 50 is prevented from flexing across substantially the entire width in the left-right direction thereof by the resin plate 56 and set in a substantially flat state in the left-fight direction and, in this state, is also prevented from sinking downwardly by the supporting cloth 58. Accordingly, as shown in FIG. 8C, overlapping due to forward sliding of the load focus point (elastic dam S) is eliminated or is set at a minimum, whereby hip slippage of the seated person is prevented. Further, due to tension fields being formed by the torsion bar 46 and the extension coil springs 54 at the rear portion of the lower layer seat 50, the seat cushion 18 as the whole can exhibit excellent cushion performance having a large damping ratio and a sufficient restoration force.

In this way, in the vehicle seat 10 according to the present embodiment, hip slippage of the seated person can be prevented without damaging the cushion performance. Further, in the vehicle seat 10 of the present invention, occurrence of lumbago due to the posture of the seated person being collapsed in accordance with the hip slippage of the seated person can be prevented. Moreover, the resin plate 56 does not deteriorate the cushion performance of the seat cushion 18, and instead, is able to provide the seated person with a sitting manner having a freedom which does not inhibit the movement of the coccygeal bone when the seated person breathes, as described above, thus resulting in a seat structure with strong restraint force acting on the seated person at the time of a vehicle collision. In other words, when an impact is applied to the vehicle seat 10, in accordance with the sinking of the seated person into the seat cushion 18 and due to the increase of the tension of the lower layer seat 50, the surface rigidity of the resin plate 56 to which the tension is applied from the lower layer seat 50 increases, whereby the rigidity of the entire seat surface portion of the seat cushion 18 becomes higher. Accordingly, at the time of the vehicle collision, the movement of the pelvis of the seated person is suppressed by the seat cushion 18 having high rigidity and the amount of displacement is reduced, so that restraint of the seated person is improved. Consequently, the seat cushion 18 allows both the restraint performance at a vehicle collision time and the freedom of the posture of the seated person at a vehicle normal time, to be achieved at the same time.

Further, at the vehicle seat 10, since the resin plate 56 is connected to the left and right side frames 28 by way of the supporting cloth 58, it is possible to form the resin plate 56 of a resin-made thin plate having a relatively low rigidity in a free state (single body). Accordingly, the resin plate 56 can be bent elastically, and the seated person is not given the sensation of a foreign body. In addition, a vibration-damping effect by the resin plate 56 can be expected.

Further, since the resin plate 56 and the supporting cloth 58 are fixed to the lower layer seat 50, occurrence of hip slippage due to the resin plate 56 and the supporting cloth 58 being displaced or slid with respect to the lower layer seat 50 can be prevented. In particular, since the front end of the resin plate 56 is held at the front frame 30 (between the front frame 30 and the lower layer seat 50), the front-rear direction swinging of the resin plate 56 upon receipt of vibrations or impacts can be prevented, and there is no occurrence of hip slippage due to such swinging (the hammock sensation phenomenon) of the seated person. Moreover, due to the structure whereby the supporting cloth 58 is stretched over the side frames 28, the resin plate 56 and the supporting cloth 58 can be easily secured to the lower layer seat 50, and there is no concern about the occurrence of dimensional errors influencing the initial tension.

Moreover, since the cut-away portions 56B are formed at the resin plate 56 so as to correspond to the thighs of the seated person, an increase of the supporting pressure to the thighs of the seated person by the provision of the resin plate 56 can be prevented. In other words, the supporting pressure acting on the thighs of the seated person is kept low, while the rear end of the resin plate 56 is positioned as rearwardly as possible, whereby the hip slippage prevention effect can be improved. In particular, as described above, the resin plate 56 is formed of a resin-made thin plate and easy to bend, and the supporting cloth 18 and the rear half portions of the cutaway portions 56B do not overlap with each other, thus making it possible to avoid giving the seated person the sensation of a foreign body at the edge portions of the cut-away portions 56B.

The present embodiment is preferably structured such that the resin plate 56 is used as a plate-like member. However, the present invention is not limited to this. For example, the plate-like member can be formed by members other than a resin, and it can be formed of resin members other than PP.

The present embodiment is structured such that a sheet of the supporting cloth 58 is stretched between the left and right side frames 28. However, the present invention is not limited to this. For example, a pair of left and right supporting cloths 58 connecting both the left and right sides of the resin plate 56 to the corresponding side frames 28, respectively, can be provided. Further, a plurality of the supporting cloths 58 can be provided along the front-rear direction.

The present embodiment is structured such that the resin plate 56 and the supporting cloth 58 are secured to the lower layer seat 50 by sewing. However, another method can be adopted to secure the resin plate 56 and the supporting cloth 58 to the lower layer seat 50. Alternatively, these three elements can be secured individually, and it is acceptable to not secure a part or the whole of these three elements.

The present embodiment is preferably structured such that the resin plate 56 has the cut-away portions 56B. However, the present invention is not limited to this. For example, the present invention can be structured such that the cut-away portions 56B are not formed. Concave portions can be formed in place of the cutaway portions 56B. In other words, the plate-like member in the present invention can have a partial solid state structure.

The present embodiment is preferably structured such that the rear end side of the lower layer seat 50 is connected, through the torsion bar 46, to the rear end side of the sitting portion frame 14. However, the present invention is not limited to this. Instead, the extension coil springs 54 can be anchored on a bar-like member which is mounted to the rear end of the lower layer seat 50 over substantially the entire width thereof such that the lower layer seat can be elastically supported (extended) thereby. Instead of the torsion bar 46, twisting coil springs can be provided around the rotational shaft of the movable frame 34. Further, the present invention is not limited to a structure in which the movable frame 34 guides the moving direction of the rear end of the lower layer seat 50. For example, the connecting pipe 44 is rotated mainly forward at a time of sitting, and instead of the movable frame 34, a linear guiding mechanism can be provided.

In addition, the above-described embodiment is structured such that the present invention is applied to the vehicle seat 10, but the present invention is not limited to this. The present invention can be applied to various types of seats such as, for example, seats for means of transport such as trains, ships, airplanes, and the like, or chairs for offices, chairs for furniture, or the like.

The foregoing description of the present invention has been provided for the purposes of illustration and description. It is not intended to be exhaustive or to limit the invention to the precise forms disclosed. Many modifications and variations will be apparent to the practitioner skilled in the art without departing from the scope and the spirit of the invention.

What is claimed is:

1. A seat, comprising:

a frame for a sitting portion having a pair of left and right side frames;

a seat material of which a front end side is fixed to a front end side of the frame for the sitting portion and of which a rear end side is connected to a rear end side of the frame for the sitting portion by way of an elastic member, the front end side of the frame is arranged opposite and substantially parallel to the rear end side of the frame;

a plate member which contacts with a region of the seat material, including a portion that supports left and right thighs of a seated person, disposed further forward than a position in the seat material that corresponds to buttocks of the seated person at a time of sitting, to prevent deformation of a contact portion of the seat material; and a fabric member which is disposed further forward than the position in the seat material that corresponds to the buttocks of the seated person and whose left and right side portions are respectively anchored to the left and the right side frames, and prevents downward sinking of a front portion of the seat material by a tension acting in accordance with sitting wherein the plate member is connected to the frame through the fabric member.

2. The seat according to claim 1, wherein the plate member is connected to each of the left and right side frames by way of the fabric member.

3. The seat according to claim 2, wherein cut-away portions are formed at a rear portion of the plate member so as to correspond to portions of the thighs of the seated person.

4. The seat according to claim 2, wherein the seat material, the plate member, and the fabric member are fixed to one another.

5. The seat according to claim 4, wherein a front end of the plate member is held at a fixing region at the front end side of the seat material in the frame for the sitting portion.

6. The seat according to claim 5, wherein cut-away portions are formed at a rear portion of the plate member so as to correspond to portions of the thighs of the seated person.

7. The seat according to claim 4, wherein cut-away portions are formed at a rear portion of the plate member so as to correspond to portions of the thighs of the seated person.

8. The seat according to claim 2, wherein a front end of the plate member is held at a fixing region at the front end side of the seat material in the frame for the sitting portion.

9. The seat according to claim 8, wherein cut-away portions are formed at a rear portion of the plate member so as to correspond to portions of the thighs of the seated person.

10. The seat according to claim 1, wherein the seat material, the plate member, and the fabric member are fixed to one another.

11. The seat according to claim 10, wherein a front end of the plate member is held at a fixing region at the front end side of the seat material in the frame for the sitting portion.

12. The seat according to claim 11, wherein cut-away portions are formed at a rear portion of the plate member so as to correspond to portions of the thighs of the seated person.

13. The seat according to claim 10, wherein cut-away portions are formed at a rear portion of the plate member so as to correspond to portions of the thighs of the seated person.

14. The seat according to claim 1, wherein cut-away portions are formed at a rear portion of the plate member so as to correspond to portions of the thighs of the seated person.

15. The seat according to claim 1, the elastic member being separate from the seat material.

16. The seat according to claim 1, further comprising:

a lower layer seat; and an upper layer seat provided above the lower layer seat, wherein the lower layer seat includes the seat material, the plate member and the fabric member, and wherein the lower layer seat cooperates with the upper layer seat to provide a three-dimensional tension field that prevents downward sinking of a front portion of the seat material.

17. A seat, comprising:

a frame for a sitting portion having a pair of left and right side frames;

a seat material of which a front end side is fixed to a front end side of the frame for the sitting portion and of which a rear end side is connected to a rear end side of the frame for the sitting portion by way of an elastic member, the front end side of the frame is arranged opposite and substantially parallel to the rear end side of the frame; and a plate member which is attached to a side of the seat material that is further forward than a position that corresponds to buttocks of a seated person and which has portions which are positioned at left-right direction external sides of thighs of the seated person and connected to the left and right side frames by way of a fabric member disposed further forward than the position that corresponds to the buttocks of the seated person.

18. The seat according to claim 1, wherein a front end of the plate member is held at a fixing region at the front end side of the seat material in the frame for the sitting portion.

19. The seat according to claim 18, wherein cut-away portions are formed at a rear portion of the plate member so as to correspond to portions of the thighs of the seated person.

20. The seat according to claim 17, wherein a front end of the plate member is held at a fixing region at the front end side of the seat material in the frame for the sitting portion.

21. The seat according to claim 20, wherein cut-away portions are formed at a rear portion of the plate member so as to correspond to portions of the thighs of the seated person.

22. The seat according to claim 17, wherein cut-away portions are formed at a rear portion of the plate member so as to correspond to portions of the thighs of the seated person.

23. The seat according to claim 17, the elastic member being separate from the seat material.

24. The seat according to claim 17, further comprising:

a lower layer seat; and an upper layer seat provided above the lower layer seat, wherein the lower layer seat includes the seat material, the plate member and the fabric member, and wherein the lower layer seat cooperates with the upper layer seat to provide a three-dimensional tension field that prevents downward sinking of a front portion of the seat material.

* * * * *